US005150678A

United States Patent [19]

Wittmann et al.

[11] Patent Number: 5,150,678

[45] Date of Patent: Sep. 29, 1992

[54] MOTOR BRAKE FOR AIR-COMPRESSING INTERNAL COMBUSTION ENGINES

[75] Inventors: Dieter Wittmann; Heribert Kubis, both of Nürnberg, Fed. Rep. of Germany

[73] Assignee: MAN Nutzfahrzeuge Aktiengesellschaft, München, Fed. Rep. of Germany

[21] Appl. No.: 552,180

[22] Filed: Jul. 12, 1990

[30] Foreign Application Priority Data

Jul. 12, 1989 [DE] Fed. Rep. of Germany ..... 3922884

[51] Int. Cl.[5] ..... F02D 9/06; F02D 13/04

[52] U.S. Cl. ..... 123/321; 123/322; 123/323

[58] Field of Search ..... 123/321, 322, 323

[56] References Cited

U.S. PATENT DOCUMENTS 4,333.430 6/1982 Rosquist ..... 123/321
4,510,900 4/1985 Quenneville ..... 123/321
4,592,319 6/1986 Meistrick ..... 123/321
4,662.332 5/1987 Bergmann et al. ..... 123/321
4,856,474 8/1989 Tisch ..... 123/323

FOREIGN PATENT DOCUMENTS 57-171011 10/1982 Japan ..... 123/323

*Primary Examiner*—Andrew M. Dolinar
*Attorney, Agent, or Firm*—Robert W. Becker & Associates

[57] ABSTRACT

A motor brake for air-compressing internal combustion engines is provided. To improve the braking power of the engine, it is proposed to combine a motor brake having a butterfly valve to throttle engine exhaust with a motor brake where an exhaust valve, in addition to the cam drive, can be raised slightly during the exhaust stroke via a piston. With this inventive combination, braking work can be performed not only in the exhaust stroke, but also in the compression stroke, so that the braking power can be increased by about 50 to 60%, and relative to conventional exhaust brakes by about 80 to 90%, and is increased to the order of magnitude of the effective engine power.

6 Claims, 4 Drawing Sheets

MOTOR BRAKE FOR AIR-COMPRESSING INTERNAL COMBUSTION ENGINES

BACKGROUND OF THE INVENTION

The present invention relates to a motor brake for an air-compressing internal combustion engine.

Motor brakes are used to assist the brake system of a commercial vehicle; these motor brakes comprise a butterfly valve in the engine exhaust. When the motor brake is actuated, the butterfly valve blocks the engine exhaust, so that during the exhaust stroke, the air in the engine cylinder and in an adjoining exhaust manifold is compressed and thus leads to a braking effect. In order to avoid pressure values that are too high, the diameter of the butterfly valve is generally less than that of the exhaust manifold. With such a motor brake, as measured against the effective power of the engine, only very modest braking powers can be achieved that can merely assist the compressed air brake.

To increase the braking power of air-compressing internal combustion engines, DE-OS 30 26 529 discloses providing in the valve drive a telescoping member that controls the effective length of a valve drive linkage to effect an opening movement of an exhaust valve. For this purpose, built into a valve lifter is a piston that is supplied with hydraulic fluid from a pump piston of a hydraulic pump unit and that, via a push rod, can open the exhaust valve beyond the regular opening phase in order to discharge compressed air in the compression stroke, as a result of which the compression work conveyed to the piston is cancelled or nullified. Each piston of the exhaust valves of a multi-cylinder internal combustion engine is connected via a line with its own pump piston of the hydraulic pump unit, which is a single unit. The pump pistons are disposed radially about a cam that rotates synchronously with a cam shaft. This cam can advantageously be disposed upon the cam shaft itself. The cam is embodied in such a way that the exhaust valves respectively open in the compression stroke in order to discharge the compressed air via an exhaust line. Such a unit permits the braking power of the engine to be increased relative to the otherwise conventional throttling in the exhaust line during the course of the exhaust stroke. Nonetheless, even with such a motor brake one is not in the position to raise the braking power to the order of magnitude of the effective power of the engine.

It is therefore an object of the present invention to further develop a motor brake such that its braking power is increased to the order of magnitude of the effective power of the engine.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The motor brake of the present invention is characterized primarily by: Piston means built into a valve drive as an additional actuation means for an exhaust valve, which is actuatable by a cam drive, with the piston means being supplied with hydraulic fluid from a hydraulic pump unit having pump pistons, a respective one of which is associated with each piston means of an exhaust valve, with the pump pistons being controlled by a cam that rotates synchronously with the cam drive; a butterfly valve disposed in an engine exhaust manifold; and a control mechanism for controlling the butterfly valve, whereby upon actuation of the motor brake, the hydraulic pump unit and the control mechanism are synchronously activatable at full braking power, and are separately activatable at gradual braking power.

By combining two known features, and by the synchronous activation of the butterfly valve and hydraulic valve actuation, the braking effect is used not only in the compression stroke but also in the exhaust stroke; in addition, a reactive effect of the air of one cylinder compressed in the engine exhaust manifold takes place upon another cylinder, the exhaust valve of which is in the open position, so that relative to a customarily utilized exhaust brake, an increase of the braking power by about 80–90% can be achieved, and relative to a motor brake known from DE-OS 30 26 259, an increase in the braking power of about 50 to 60% can be achieved, and the braking power nearly equals the effective power of the engine. Thus, when driving for a long time down a grade, the compressed air brake is relieved and the driving speed down a grade can be increased. The result is a considerable reduction in wear of the brake linings. In addition, the danger of brake failure due to overheating is reduced.

Further specific features of the present invention will be described in detail subsequently.

Description of Preferred Embodiments

Figure 1:
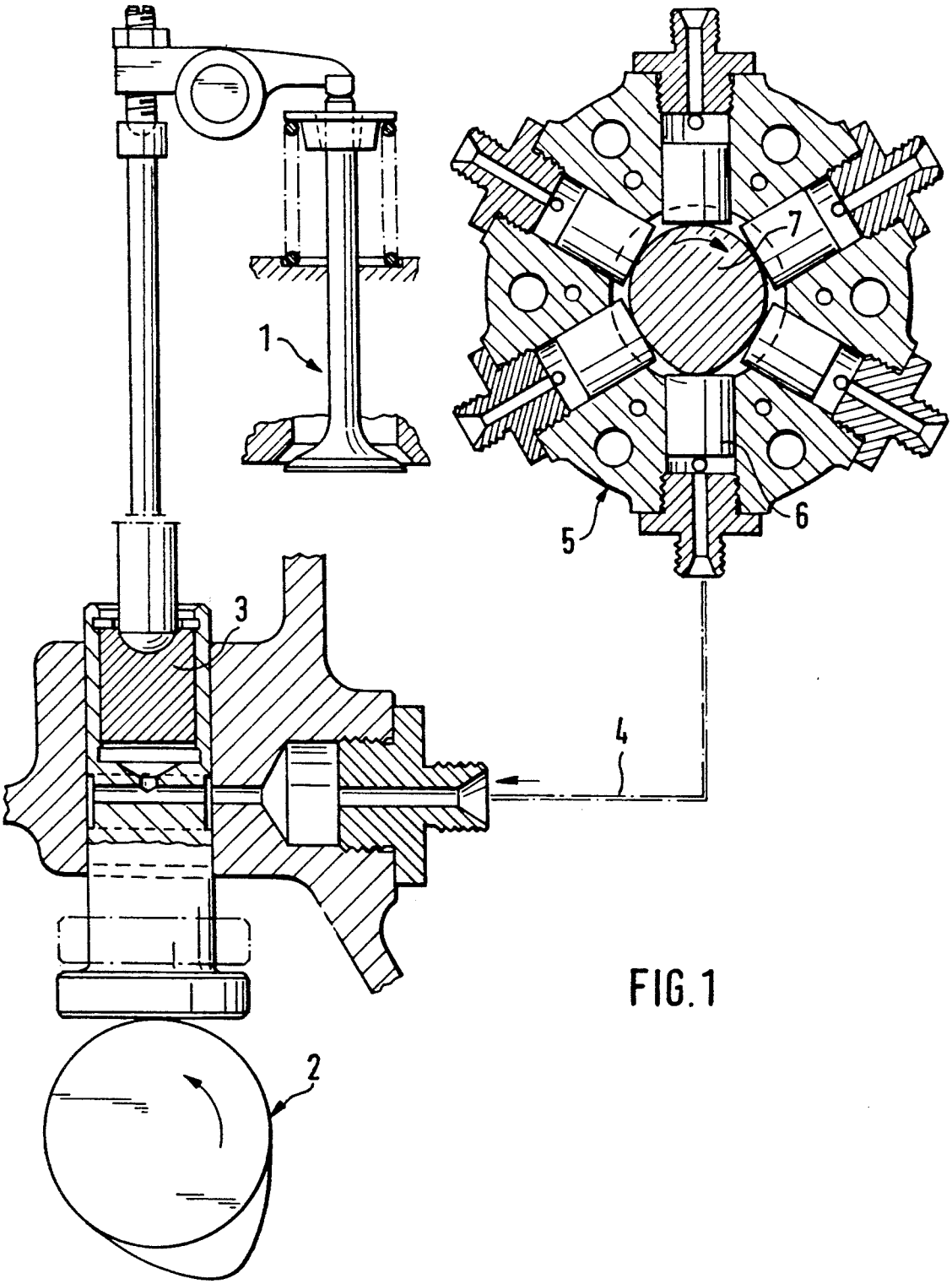
FIG. 1 shows one exemplary embodiment of a valve drive with a hydraulic pump unit and piston for actuating an exhaust valve.

Referring now to the drawings in detail, the exhaust valve 1 illustrated in FIG. 1 is controlled not only by a cam drive 2, but in addition can be moved by a piston 3. This piston 3 is supplied with hydraulic fluid via a line 4 coming from a hydraulic pump unit 5. In the hydraulic pump unit 5, a respective pump piston 6 is associated with each piston 3 of the exhaust valve 1 of a multi-cylinder internal combustion engine. By means of a cam 7, the pump piston 6 can be lifted in such a way that the exhaust valve 1 can be raised by the piston 3 as shown in the illustrated operating phase. As a result, during a compression stroke, the compressed air, throttled by the exhaust valve 1, can be released or discharged into an engine exhaust manifold 8 (FIG. 2) and the rearward expansion work can be nullified by the inventively selected control times. Thus, in addition to the exhaust work that is otherwise customary with motor brakes, the compression work that is to be performed by an engine piston is available as braking energy against a throttle in the engine exhaust manifold 8. For structural details of the hydraulic pump unit 5 and exhaust valve 1, which are not necessary for the understanding of the present invention, reference is made to the aforementioned DE-OS 30 26 529.

Figure 2:
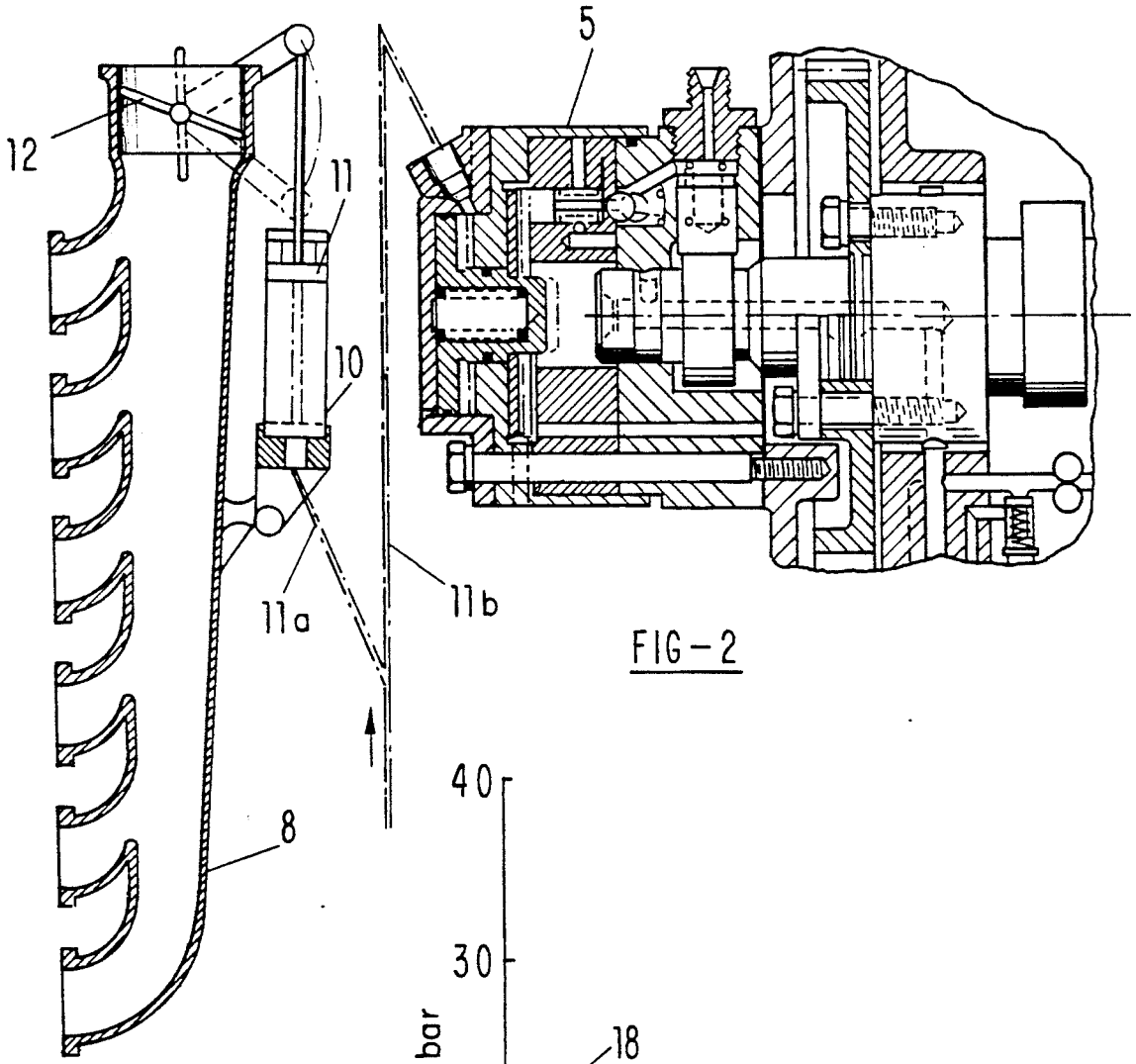
FIG. 2 shows a hydraulic pump unit with a throttle built into an exhaust manifold and showing a common control means.
Figure 5:
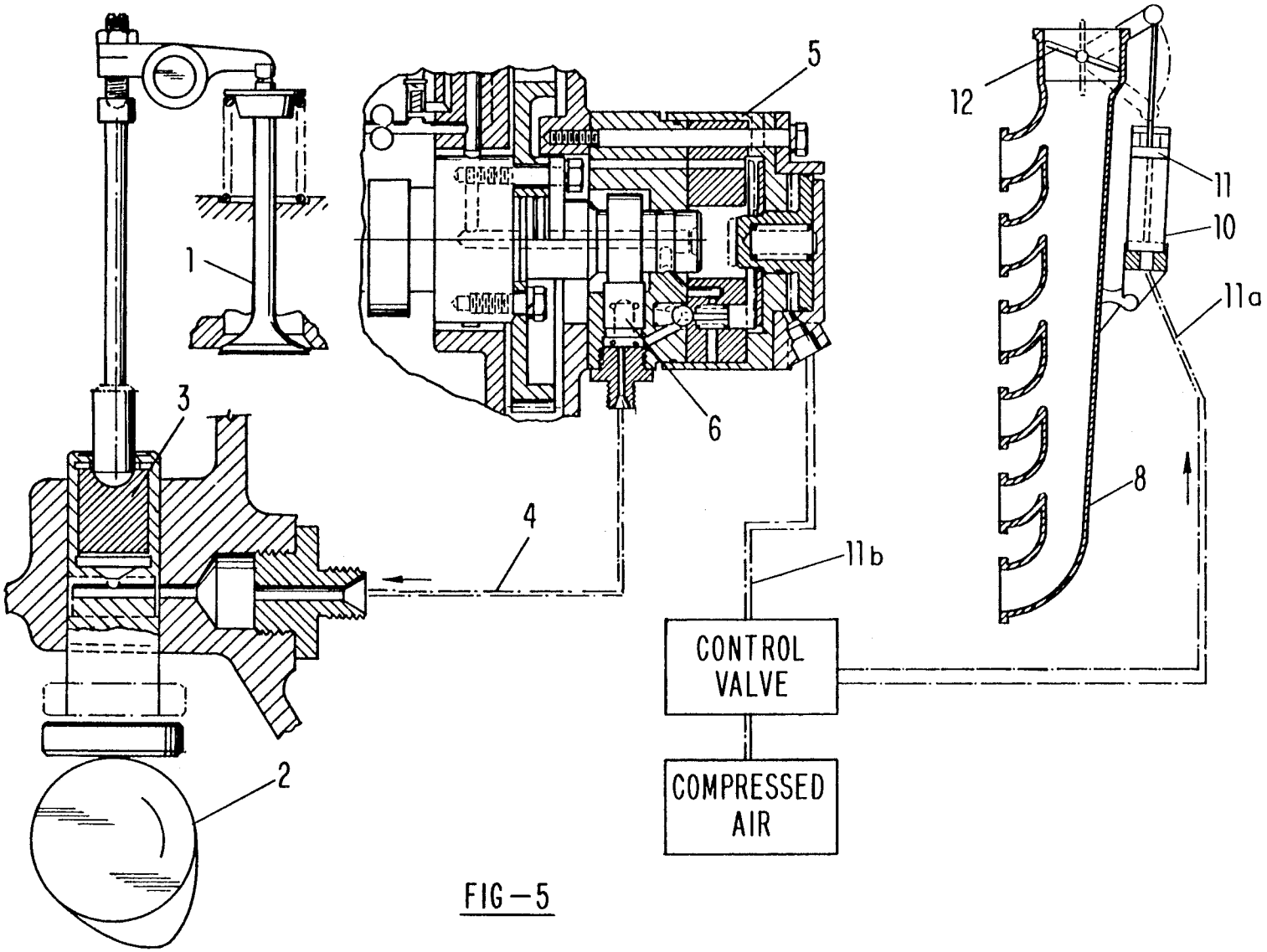
FIG. 5 shows an embodiment of the present invention having a common control valve with which the hydraulic pump as well the control mechanism are synchronously or separately activatable.

Pursuant to the present invention, and in accordance with FIG. 2, this type of motor brake is combined with a generally known motor brake where via actuation of the motor brake the engine exhaust manifold 8 is partially blocked by a butterfly valve 12. Control of the butterfly valve 12 is effected via a control mechanism 10 that in the illustrated embodiment is in the form of a pneumatic piston/cylinder unit 11, although it could also be an electrical or hydraulic mechanism. To achieve the maximum braking effect, by activating the motor brake at the same time the hydraulic pump unit 5 is activated in that via a control valve as shown in FIG. 5, compressed air is supplied from a vehicle braking system and via a compressed medium line, which branches into a first and second line 11*a* and 11*b*, not only to the piston/cylinder unit 11 but also to the hydraulic pump unit 5.

As a consequence of the simultaneous, i.e. synchronous, activation of the piston/cylinder unit 11 and the hydraulic pump unit 5, braking work is performed not only in the compression stroke but also in the exhaust stroke. While the butterfly valve 12 in the engine exhaust manifold 8 is closed, the exhaust valve 1 is opened by the piston 3 via the pump piston 6 during the compression stroke and the compressed air, throttled by the exhaust valve 1, is discharged into the engine exhaust manifold 8, which is closed off by the butterfly valve 12, as a result of which the rearward expansion work is nullified. In order to prevent too great of a pressure head from being formed in the engine exhaust manifold 8, the butterfly valve 12 has a slightly smaller diameter than does the engine exhaust manifold, so that an annular gap remains through which a portion of the compressed air can escape. Of particular advantage is the reactive effect of the compressed air upon the pistons of the other cylinders, the exhaust valves of which are at that time in the open position so that these cylinders can then add to the braking power.

Figure 3:
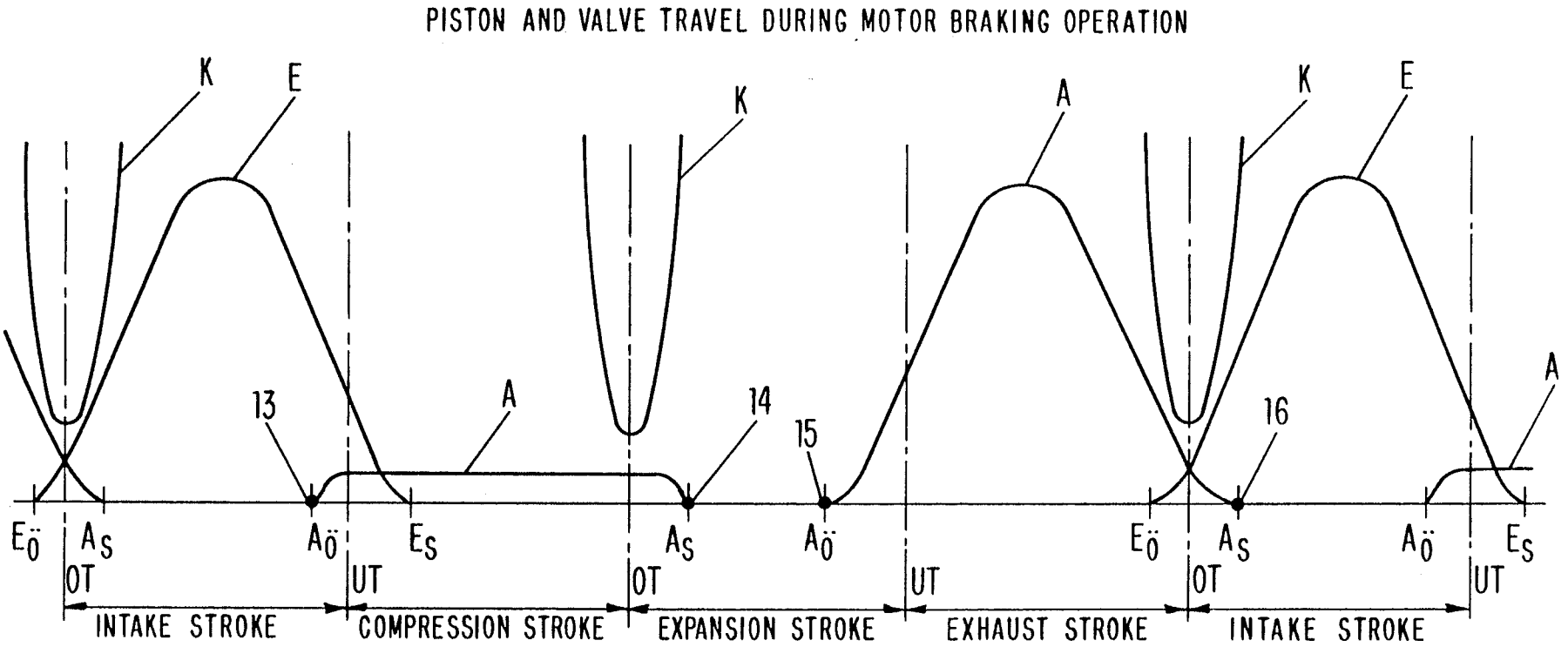
FIG. 3 is a timing diagram showing piston and valve travel.

FIG. 3 shows a timing diagram of piston, intake valve, and exhaust valve, with the opening stroke of the valves, or the piston travel, being plotted as a function of the crank angle. From this diagram it can be seen that in a first opening phase, the exhaust valve opens at a first point 13 somewhat more than 180° prior to an ignition dead center position, and closes at a point 14 shortly after the ignition dead center position. In this opening phase, the stroke of the exhaust valve is approximately 1 to 2.5 mm. The compressed air, throttled by the only partially opened exhaust valve 1 (FIG. 1), is discharged against a pressure of approximately 5 to 6 bar that builds up due to the closing of the butterfly valve 12. As a consequence of the discharge of the air in the compression stroke, the rearward expansion work is nullified.

Analytical tests have shown that a maximum braking effect occurs if in addition to a second opening phase of the exhaust valve during normal operation between the points 15 and 16, via the hydraulic pump unit 5 (FIG. 1) the first opening phase between the points 13 and 14 is initiated between the crank angles 180°±40° prior to the ignition dead center point OT and 40°±40° after the ignition dead center position OT.

A particular advantage of these control times is that at maximum braking power, only a slight loading of an engine valve drive and the hydraulic exhaust valve control means results since the final compression pressure has been greatly reduced.

Figure 4:
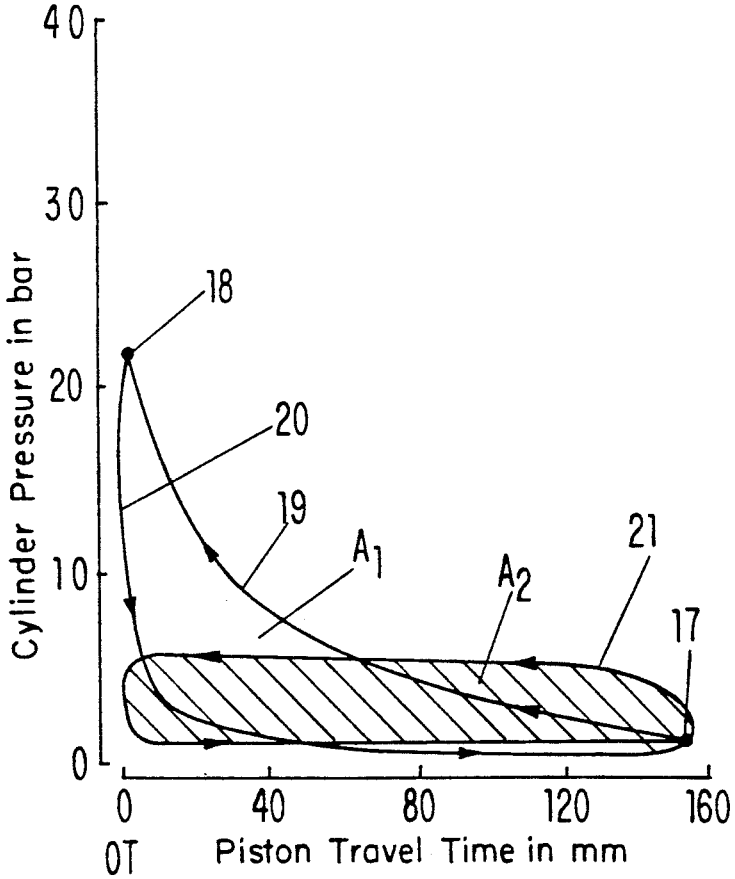
FIG. 4 is a pressure/piston travel diagram of the combination brake.

The braking work performed upon actuation of the motor brake is illustrated in the pressure/piston diagram of FIG. 4. Starting at point 17, the air is first discharged against the pressure that builds up in the engine exhaust manifold 8 (FIG. 2), in conformity with the curve 19, until the top dead center position is reached at the point 18. During a subsequent expansion stroke, the pressure drops in conformity with the curve 20 until the bottom dead center position is again reached at the point 17.

The exhaust stroke follows the opening of the exhaust valve pursuant to the normal engine operation (see points 15 and 16 in FIG. 3), whereby the pressure curve, starting at the point 17, is in conformity with the curve 21 until again the top dead center position is reached and, after opening an intake valve, the pressure drops to the pressure that prevails in the intake system.

The braking work performed in the first opening phase of the exhaust valve is illustrated by the surface $A_1$ that is cross-sectioned perpendicular to the abscissa, and the braking work performed in the second opening phase of the exhaust valve is represented by the surface $A_2$ having the angled cross-sectioning In contrast to the previously widely known exhaust brake, the braking power of the inventive arrangement is increased by approximately 80 to 90%, and in contrast to a motor brake pursuant to the aforementioned DE-OS 30 26 529, a braking power that is increased by approximately 50 to 60% is achieved, which at maximum engine speed nearly reaches the effective power. The inventive motor brake can also be operated in a gradual manner if either only the hydraulic pump unit 5 or the butterfly valve 12 (FIG. 2) are actuated separately from one another.

A particular advantage of the inventive motor brake consists in the complete utilization of the mechanical strength of the piston drive and crank assembly, and of the engine cooling system in braking operation.

The present invention is, of course, in no way restricted to the specific disclosure of the specification and drawings, but also encompasses any modifications within the scope of the appended claims.

What we claim is:

1. A motor brake for an air-compressing internal combustion engine, comprising:

piston means built into a valve drive as an additional means for an exhaust valve that is actuatable by a cam drive, with said piston means being supplied with hydraulic fluid from a hydraulic pump unit having pump pistons, a respective one of which is associated with each piston means of an exhaust valve, with said pump pistons being controlled by a cam that rotates synchronously with said cam drive;

a butterfly valve disposed in an engine exhaust manifold;

a control mechanism for controlling said butterfly valve; and a common control valve for activating said hydraulic pump unit and said control mechanism synchronously at least at full braking power.

2. A motor brake according to claim 1, in which said control mechanism is a pneumatic piston/cylinder unit that upon actuation of said motor brake is supplied with compressed air from a vehicle braking system.

3. A motor brake according to claim 1, in which said control mechanism is an electrical mechanism.

4. A motor brake according to claim 1, in which said control mechanism is a hydraulic mechanism.

5. A motor brake according to claim 1, in which said cam of said hydraulic pump unit is embodied in such a way that said exhaust valve is opened via said piston means in a range 180°±40° crank angle prior to top ignition dead center position, and is again closed in a range 40°±40° crank angle subsequent to ignition dead center position.

6. A motor brake for an air-compressing internal combustion engine, comprising:

piston means built into a valve drive as an additional means for an exhaust valve that is actuatable by a cam drive, with said piston means being supplied with hydraulic fluid from a hydraulic pump unit having pump pistons, a respective one of which is associated with each piston means of an exhaust valve, with said pump pistons being controlled by a cam that rotates synchronously with said cam drive;

a butterfly valve disposed in an engine exhaust manifold;

a control mechanism for controlling said butterfly valve; and a common control valve for activating said hydraulic pump unit and said control mechanism synchronously at least at full braking power;

said control mechanism is a pneumatic piston/cylinder unit that upon actuation of said motor brake is supplied with compressed air from a vehicle braking system; and said control mechanism is supplied with compressed air from a pressure line that comes from said common control valve and branches off to said piston/-cylinder unit and to said hydraulic pump unit.

* * * * *